United States Patent [19]

Hellgren

[11] 4,163,378

[45] Aug. 7, 1979

[54] HYDRAULIC PRESS

[75] Inventor: Keijo E. Hellgren, Vesteras, Sweden

[73] Assignee: ASEA Aktiebolag, Vesteras, Sweden

[21] Appl. No.: 917,503

[22] Filed: Jun. 21, 1978

[30] Foreign Application Priority Data

Jun. 27, 1977 [SE] Sweden ..... 7707358

[51] Int. Cl.[2] ..... B21D 22/12

[52] U.S. Cl. ..... 72/63

[58] Field of Search ..... 72/60, 63, 54; 29/421 R

[56] References Cited

U.S. PATENT DOCUMENTS

| | | | |
|---|---|---|---|
| 2,854,940 | 10/1958 | Bates | 72/63 |
| 3,051,712 | 8/1962 | Van Leer et al. | 72/63 |
| 3,527,076 | 9/1970 | Landa et al. | 72/63 |
| 3,531,966 | 10/1970 | Pappa | 72/63 |
| 3,757,555 | 9/1973 | Blutt | 72/63 |
| 4,079,613 | 3/1978 | Syvakais | 72/63 |
| 4,087,037 | 5/1978 | Schier | 72/63 |

*Primary Examiner*—Leon Gilden

*Attorney, Agent, or Firm*—Watson, Cole, Grindle & Watson

[57] ABSTRACT

In a hydraulic press for forming sheet material, a vertically extending forming cavity is formed in a horizontally extending press stand between a pair of spaced forming pads extending between the inner surfaces of the press stand, and an elastically deformable member extends between the respective end of each of the forming pads for supporting the same. A tool carrier, with an upstanding tool support member having a tool forming depression on each side thereof on which sheet material is formed, is movable into and out of the forming cavity on respective support and guide rails which are engaged by respective support and guide rollers on the tool carrier. The tool carrier divides the forming cavity into a pressure seal on each side of the upstanding tool support member. A pressure medium is injected into each of the pressure cells to form the sheet metal.

7 Claims, 4 Drawing Figures

HYDRAULIC PRESS

BACKGROUND OF THE INVENTION

The present invention relates to those type of presses having a very large working surface in which sheet material is shaped against a tool by being pressed against it by means of a forming pad actuated by a pressure cell.

To achieve the high press forces which are desirable, the press stand is constructed with a tubular force-absorbing part, usually with a cylinder having a surrounding strip sheath composed of strips of high tensile steel. Filling portions and a pressure cell with diaphragms are formed in the cylinder. A horizontal rectangular working space is formed between the aforementioned constructional elements. The sheet material is placed on a tool in a depression in a tool carrier movable between a position outside the press stand where the sheet material is placed on the tool, and a position in the press stand where the sheet material is shaped. Previously, the prior art tool carrier has been designed as a horizontal trough.

SUMMARY OF THE INVENTION

According to the invention the tool carrier consists of a vertically oriented tool support having depressions on both sides thereof in which the tool and sheet material to be shaped are placed. Filling pieces and a holder for the pressure cell with its diaphragms and forming pad are placed vertically oriented in the press cylinder sides, thus forming a vertical forming cavity adapted to receive the tool carrier. Support and guide rails for the tool carrier are arranged in the press stand at the upper and lower walls of the working space. The rails are suitably provided with guide slots, guide wheels, or rollers for supporting the tool carrier, but other embodiments are also possible.

The tool carrier can be supported at the bottom ends thereof by vertically extending wheels and be guided at the top by horizontal wheels or rollers which run in the slots of the guide rail mentioned above. The tool carrier can be limited at the top and bottom thereof by rails having a cross-section adapted to the guide rails. Strips of elastic material may be inserted between these rails and the main portion of the tool carrier. The pressure forces from the forming pad compress these strips from the sides and then press the rails against the guide rails so that the press stand cylinder is influenced by a radially outwardly-directed force. This force counteracts deformation of the cylinder which would otherwise occur and which would involve undesirable stresses.

The upper and lower sides of the forming pads are designed with flanges which are secured in slots formed between the press stand cylinder and the guide rails and also in the support members in which the pressure cells and the forming pads are arranged in depressions between flanges at the end portions of the support members. The slot between the support members and the cylinder extends all the way to the filling piece. The flanges in the slots are compressed by the fact that the pressure in the pressure cell is propagated in the material of the forming pad. In this way an outwardly-directed radial force is obtained also at the flanges, which force contributes to limiting the deformation of the cylinder of the press stand.

In accordance with the invention a working space is obtained which is about twice the size of that obtained in previously known presses since the two sides of the tool carrier can be utilized for the press tool and the workpieces. The manufacturing capacity per press cycle is doubled. Since the tool carrier is vertically oriented, its stiffness is very great and its deflection negligible. No laterally doforming forces will occur. This means that the clearance between the sides of the tool carrier and the holder for the diaphragms and the forming pad may be small, and may be considerably smaller than in previously known presses. This design also improves the possibility of loading the press stand cylinder evenly so that deformations, with a resultant increase of the stresses, can be substantially avoided although the space between the filling pieces outside the pressure cell fastening members is larger than in previous presses. The symmetrical construction makes possible a desirable even force distribution by simple means. The design of the forming pads with longitudinal flanges which fill up the slots between the cylinder and the supports for the tool carrier, as well as the elastic members between the main portion of the tool carrier and its longitudinal rail, means that the elastic material covers the entire distance between the filling pieces of the press stand and propagates the pressure in the pressure cell so that a substantially uniform radial loading is obtained over the whole circumference. This results in a small deformation and a favorable stress configuration. The two-sided design results in the forces being evenly distributed and the tool carrier maintaining its planeness during the pressing operation, and when pressing large heat exchanger plates, for example, such characteristics are of great importance for achieving the best quality of pressed plates.

BRIEF DESCRIPTION OF THE FIGURES

The invention will be described in greater detail with reference to the accompanying Figures wherein.

DETAILED DESCRIPTION

Figure 1:
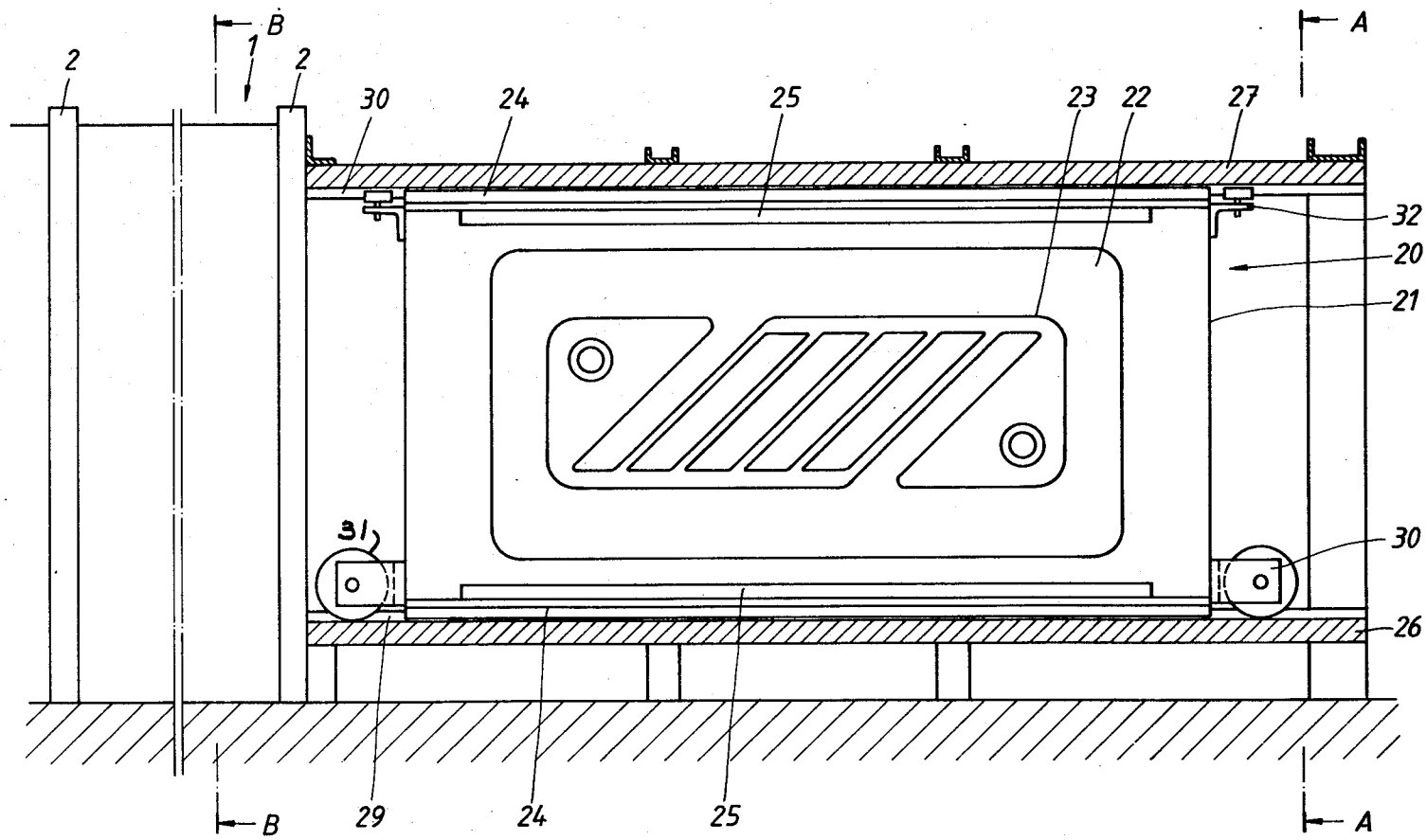
FIG. 1 shows a side view of a press with the tool carrier outside the press stand; however, one section is shown through the support bars and guide bars.
Figure 2:
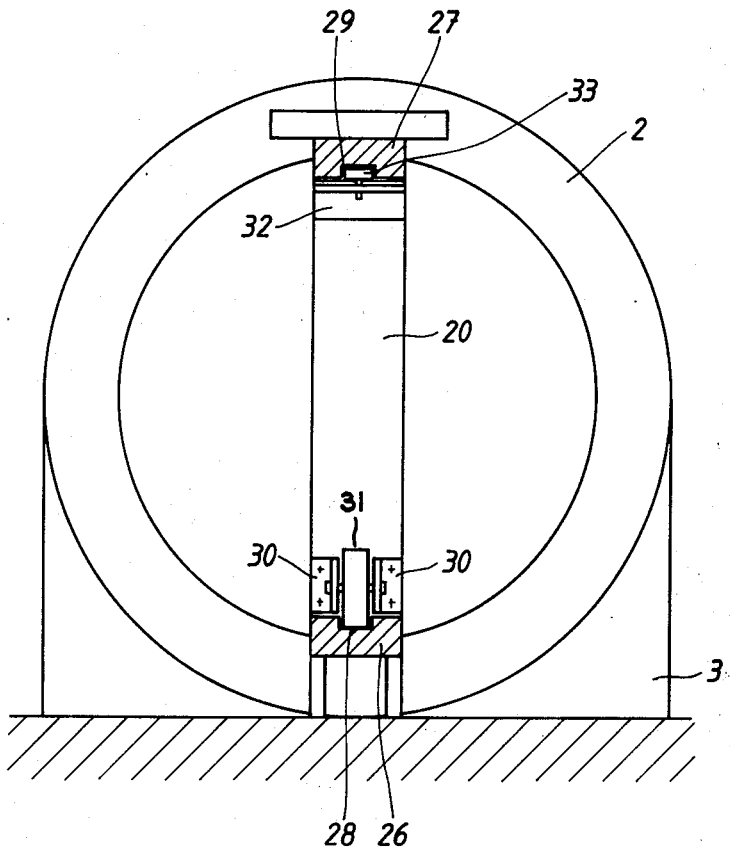
FIG. 2 shows an end view and the section indicated by A—A in FIG. 1.
Figure 3:
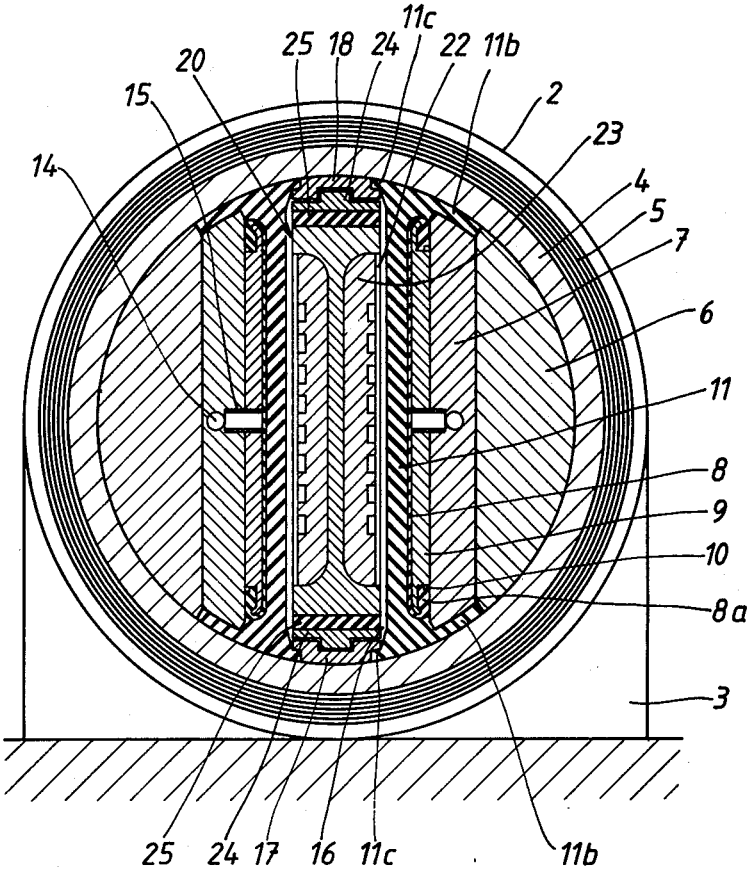
FIG. 3 is a section indicated by B—B in FIG. 1.
Figure 4:
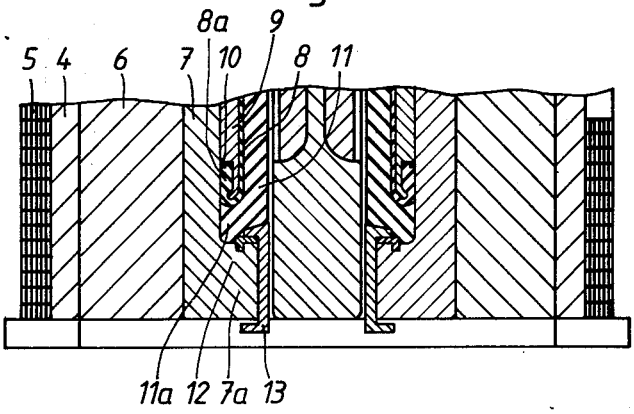
FIG. 4 is a horizontal section through the end portion of the press.

Press stand 1 is provided with a round cross-section and end pieces 2 formed with supports 3. Press stand 1 is tube-shaped and comprises cylinder 4 surrounded by force-absorbing strip sheath 5. Two filling elements 6 are vertically arranged at the sides of press stand cylinder 4 and two first support members 7 with end flanges **7*a* are arranged inside the filling elements. A pressure cell is placed in the depression between end flanges 7*a*. The pressure cell contains bag-type diaphragm 8 having an opening which is surrounded by bead 8*a*, and is secured against each first support member 7 by each second support member 9 with a recess around the periphery thereof and adapted to bead 8*a*. Bead 8*a* contains a recess for sealing ring 10. Inside diaphragm 8 is forming pad 11 with bead 11*a* formed at the end portions thereof for securing forming pad 11 between bead 8*a* on the diaphragm and locking rail 12. Sealing rail 13 is provided to prevent forming pad 11 from being pressed out during a pressing operation. The pressure cell is supplied with a pressure medium through each channel 14 in each support member 7 and each tube 15 which bridges the gap between each first support member and each second support member 9. The upper and lower sides of each forming pad 11 are designed to be connected to the outer portion of diaphragm 8 and are designed with flanges 11*b* and 11*c* by means of which each forming pad 11 is fixed to press stand 1. Each flange 11*b* is fixed in the gap which is formed between cylinder 4 and the sides of each respective first support member 7. Each flange 11*c* is fixed in a respective gap between cylinder 4 and a respective slot 16 which is formed by cylinder 4 and a respective recess in rails 17 and 18** which are placed at the lower and upper portions of the cylinder.

Between forming pads 11 and rails 17 and 18 there is formed a vertically oriented rectangular forming cavity. Vertical disc-shaped tool carrier 20 is movable between an outer position, as shown in FIG. 1, and an inner position in the cavity. In the position outside press stand 1 sheet material is applied on forms prior to the pressing operation and is removed after pressing. In the position inside press stand 1, forming pad 11 is pressed against the sheet material by filling the pressure cell with pressure medium. Tool carrier 20 consists of vertically positioned tool support 21 with recesses 22 in which tool 23 and the sheet material (not shown) to be pressed are placed. Tool carrier 20 is limited at the top and bottom thereof by rails 24 having a cross-section adapted to bar rails 17 and 18. Between tool support 21 of the tool carrier and rails 24 there are placed strips 25 of an elastic material. During the pressing, strips 25 are influenced by forming pads 11 and are compressed from the sides so that rails 24 are pressed out towards rails 17 and 18.

Outside press stand 1 there are lower bar 26 and upper bar 27 which are connected with bar rails 17 and 18 and have a cross-section adapted thereto with slots 28 and 29, respectively. At the lower part of tool carrier 20 there are brackets 30 between which supporting wheels 31 are journalled. Wheels 31 run on rails 26 and 17, respectively, and are guided by the slots therein. At the upper part of tool carrier 20 there are brackets 32 on which there are journalled horizontally oriented guide wheels 33. Wheels 33 run in the slots in rails 17 and 18 and are guided towards the slot sides. Drive equipment necessary for transporting tool carrier 20 and the pumps and other aids for supplying the pressure cells are not shown.

I claim:

1. A hydraulic press for forming sheet material, comprising:

a horizontally extending press stand including a vertically extending forming cavity formed therein between a pair of spaced forming pads extending between the inner surfaces of said press stand, and an elastically deformable member extending between the respective end of each said forming pad for supporting the same;

a tool carrier movable into, and out of, said forming cavity and including an upstanding tool support member having a tool forming depression on each side thereof on which sheet material is formed, said tool carrier dividing said forming cavity into a pressure cell on each side of said upstanding tool support member; and means for injecting a pressure medium into each of said pressure cells.

2. A hydraulic press as in claim 1 wherein said press stand further comprises a guide rail between the respective ends of said pair of spaced forming pads, and said tool carrier further comprising a support roller at each bottom end thereof engaging the bottom guide rail, and a guide roller at each upper end of said tool carrier engaging the top guide rail.

3. A hydraulic press as in claim 2 wherein the top and bottom guide rails each include a slot, and said support roller and said guide roller engage a respective one of said slots.

4. A hydraulic press as in claim 2 wherein said tool carrier further comprises a top rail extending substantially between said guide rollers and a bottom rail extending substantially between said support rollers, and a strip of elastic material between each of said top and bottom rails and said tool support member.

5. A hydraulic press as in claim 2 wherein said press stand further comprises a support member for supporting each of said forming pads and the respective elastically deformable member, each of said forming pads including a flange having oppositely extending flange portions at each end of the forming pad, a slot being formed between the inner surface of said press stand and each of said bottom and top guide rails, a depression being formed between each end of each of said support members and the inner surface of said press stand, one flange portion at each end of said forming pads is secured in a respective one of said slots and the oppositely extending flange portion at each end of each of said forming pads is secured in a respective one of said depressions.

6. A hydraulic press as in claim 5 wherein each said support member includes first and second support members formed in abutting relationship, each said elastically deformable support member including a bead portion at each opposite end thereof, each said first support member being retained at each end thereof between a respective bead portion and each of said bead portions including a recess, and said press stand further comprising a sealing ring in each said recess.

7. A hydraulic press as in claim 6 wherein said means for injecting includes a pressure medium channel formed in each of said second support members and a bridging tube extending between each of said pressure medium channels and each of said elastically deformable support members.

* * * * *